US005558581A

United States Patent [19]

Knijpstra

[11] Patent Number: 5,558,581

[45] **Date of Patent: *Sep. 24, 1996**

[54] FAIRGROUND DEVICE

[75] Inventor: Hette Knijpstra, EC Terband, Netherlands

[73] Assignee: Knijpstra Konstruktie B.V., Terband, Netherlands

[ * ] Notice: The term of this patent shall not extend beyond the expiration date of Pat. No. 5,395,290.

[21] Appl. No.: 378,364

[22] Filed: Jan. 25, 1995

Related U.S. Application Data

[62] Division of Ser. No. 50,500, filed as PCT/NL91/00218 Nov. 4, 1991, Pat. No. 5,395,290.

[30] Foreign Application Priority Data

Nov. 2, 1990 [NL] Netherlands ..... 9002399

[51] Int. Cl.[6] ..... A63G 1/08

[52] U.S. Cl. ..... 472/31; 472/1; 472/29

[58] Field of Search ..... 472/29, 30, 31, 472/32, 35–44, 1, 3, 36, 37, 38, 39, 43; 297/326, 344.21, 344.24

[56] References Cited

U.S. PATENT DOCUMENTS 3,101,943 8/1963 Bartlett ..... 472/36

*Primary Examiner*—Kien T. Nguyen

*Attorney, Agent, or Firm*—Griffin, Butler, Whisenhunt & Kurtossy

[57] ABSTRACT

A fairground device has a base disc driven for rotation about a central axis, seat supports carried by the base disc in a spaced relation relative to the central axis for rotation of the seat supports about a second axis, and seats mounted eccentrically relative to a corresponding second axis. In the improvement, the seats are mounted on the seat supports for rotation about a third axis extending substantially transversely to the second axis. The base disc has a plurality of longitudinally extending radial arms pivotally connected to a central hub for pivoting the radial arms about an axis extending transversely to the longitudinally extending radial arms and for carrying the seat supports. A positioning device sets the pivotable position of the radial arms.

26 Claims, 11 Drawing Sheets

FAIRGROUND DEVICE

This application is a divisional of application Ser. No. 08/050,500, filed as PCT/NL91/00218 Nov. 4, 1991, now U.S. Pat. No. 5,395,290, issued on Mar. 7, 1995.

This invention relates to a fairground device comprising a base disc driven for rotation about a central axis and a plurality of seat supports mounted in spaced relation relative to the central axis for rotation about a second axis, each of the seat supports carrying a plurality of seats mounted eccentrically relative to the corresponding second axis.

BACKGROUND OF THE INVENTION

Such a fairground device is known from European Patent Application 0082435. In this known device, the seats are rotatable about the second axis of an associated seat support. During operation of such a device, the passenger simultaneously experiences the sensation caused by the rotation of the base disc and the sensation caused by the seat rotating about the second axis which is spaced from the central axis of the base disc.

To modify this combination of sensations, which was already known as such, it is proposed in European Patent Application 0082435 to slightly incline the second axis, ie. the axis of rotation of the seat supports, relative to the central axis of the base disc. As a result, the level of the seat during rotation about the second axis varies.

The shaft of the second axis can be mounted on the base disc as well as on a rotatable intermediate disc mounted on the base disc. Further, the central axis of the base disc of the known device can optionally be slightly inclined.

The object of the invention is to increase the thrill of the sensation aroused by the known devices, i.e. the above-described devices, which may or may not comprise intermediate discs and may or may not be provided with an inclined central axis and/or an inclined second axis.

SUMMARY OF THE INVENTION

To that end, according to the invention, as a central feature, a fairground device of the type described hereinabove is characterized in that the seats are mounted on at least one seat support(s) for rotation about a third axis extending transversely to the second axis. The base disc has a plurality of longitudinally extending radial arms pivotally connected to a central hub for pivoting the radial arms about an axis extending transversely to the longitudinally extending radial arms and for carrying the seat support(s). Positioning means set the pivotable position of the radial arms. In addition, further motion of the seats may be induced by additional devices according to the invention.

BRIEF DESCRIPTION OF THE DRAWINGS

Hereinafter, the invention will be further described with reference to the accompanying drawings of some embodiment. In said drawings.

DETAILED DESCRIPTION OF PREFERRED EMBODIMENTS

Figure 1:
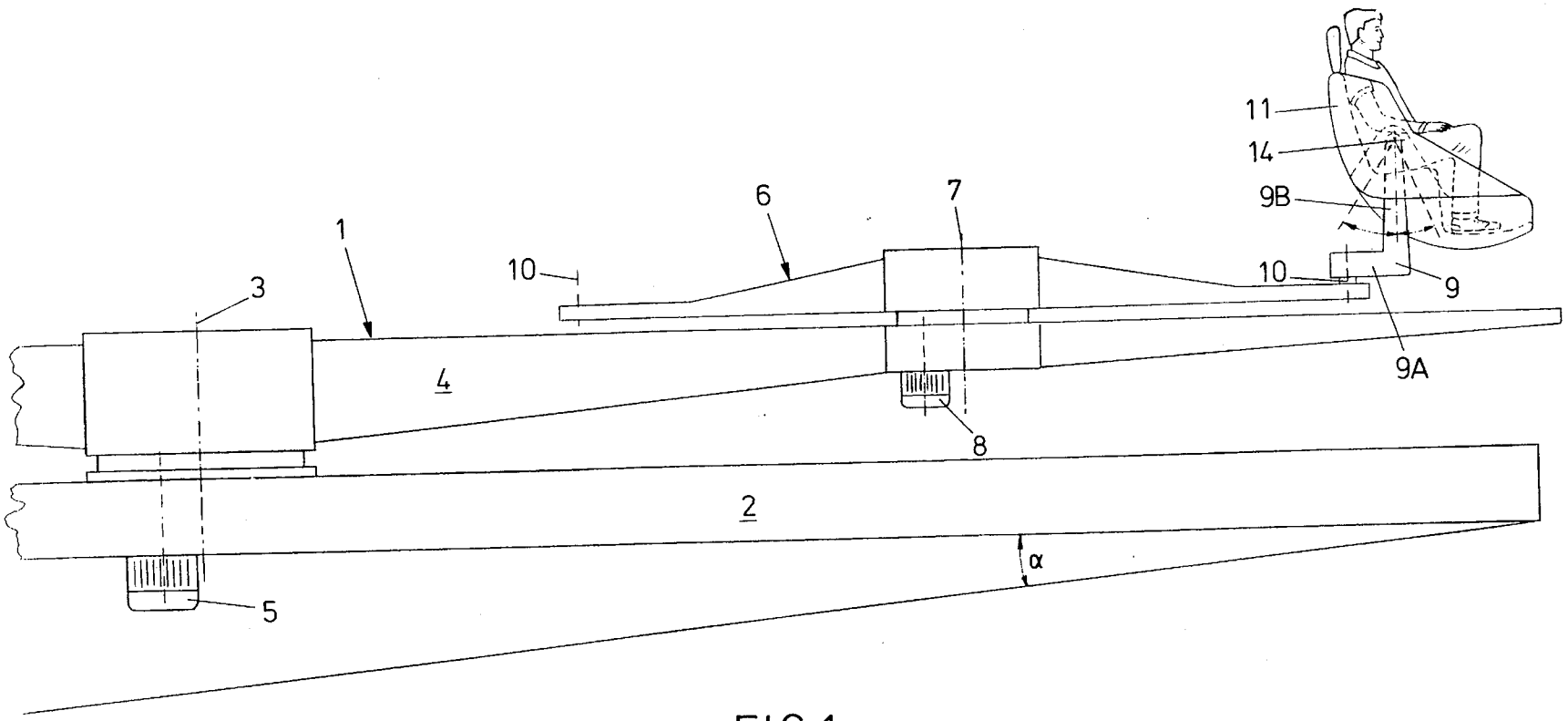
FIG. 1 is a diagrammatic side elevation of a part of a fairground device according to the invention.

FIG. 1 is a diagrammatic view of a fairground device 1, comprising a base plate 2 having a base disc 4 mounted thereon for rotation about a central axis 3. The base disc 4 can be driven for rotation about the central axis 3 by means of a diagrammatically shown motor 5, which may be an electric motor or a hydromotor.

The base disc 4 can be arranged horizontally, but in practice often makes an angle $\alpha$ with the horizontal, as shown in FIG. 1.

In this embodiment, the base disc 4 mounts a plurality of intermediate discs 6, each of which may be driven for rotation about fourth axis 7 by means of a motor 8. Arranged near or adjacent the perimeter of an intermediate disc 6 are one or more seat supports 9. The seat supports are mounted on the intermediate disc 6 for rotation about a second axis 10. The movement of the seat support 9 relative to the intermediate disc 6 may be undriven or driven. In this embodiment, the seat support is of L-shaped design, viewed in side elevation, the second axis 10 being located adjacent the free end of the short horizontal leg 9A of the L-shaped seat support 9. Thus, the seat supports 9 have a first part 9A supporting the seats 11 that points away from the second part 9B that carries the seats and has an orientation different from the first part 9A. The first part 9A usually comprises a hub rotatable about the second axis.

Figure 8:
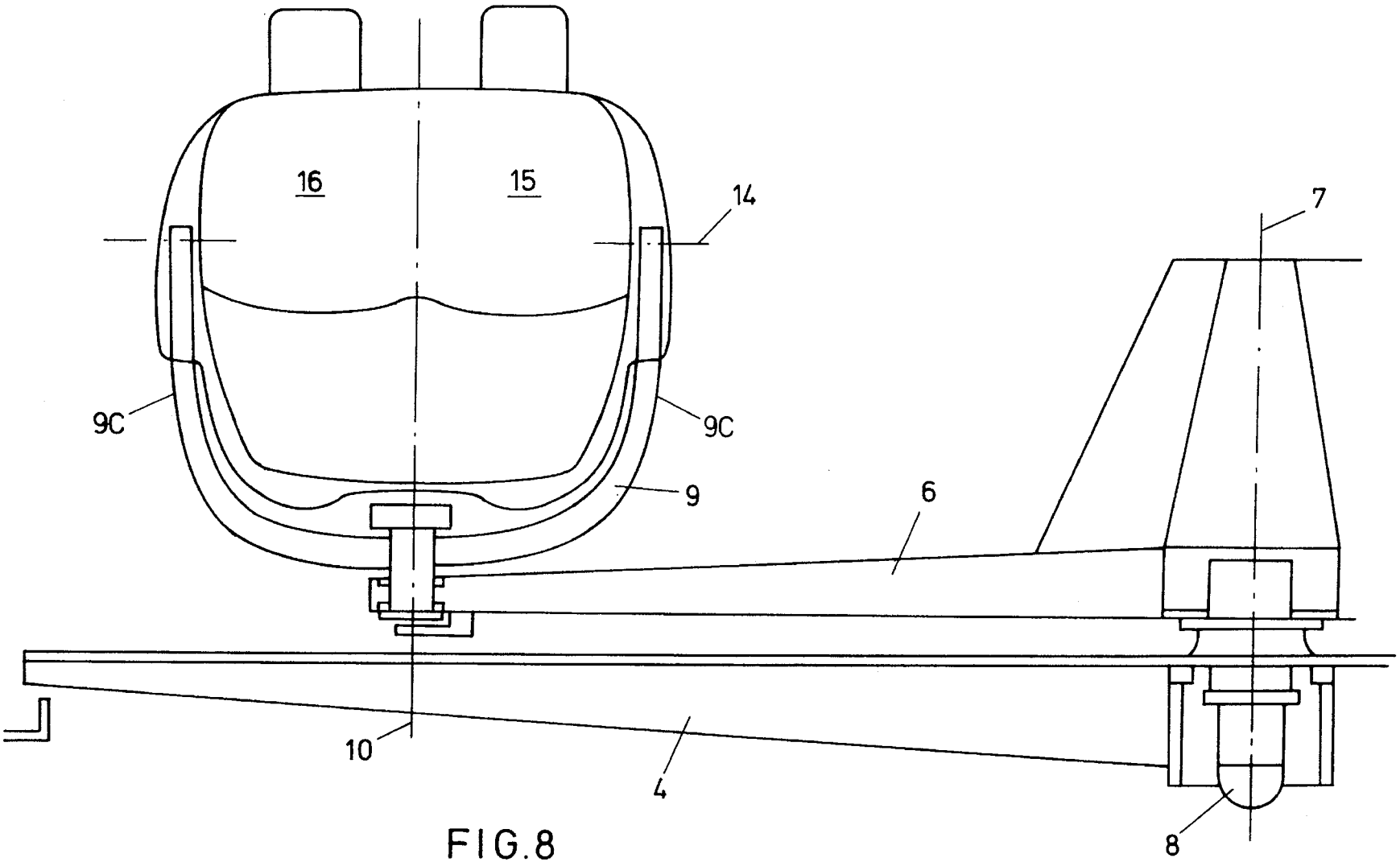

The upright leg 9B of the L-shaped seat support 9 may in turn have at least one U-shaped part, e.g. legs 9C, as shown in FIG. 8, so that at least one seat 11 can be rotatably mounted between the legs thereof. The seat 11 is mounted for rotation relative to a transverse third axis 14, i.e. transverse to second axis 10. Accordingly, the seat 11 can rock and/or rotate about the transverse third axis 14. This motion may be undriven or driven. The rotation of the intermediate disc 6 can also be undriven, if so desired, but it is preferred that it be driven. The seat can comprise one or more seating positions to suit requirements. FIG. 8, for instance, schematically shows a seat having two seating positions 15, 16 in side-by-side arrangement.

Figure 9:
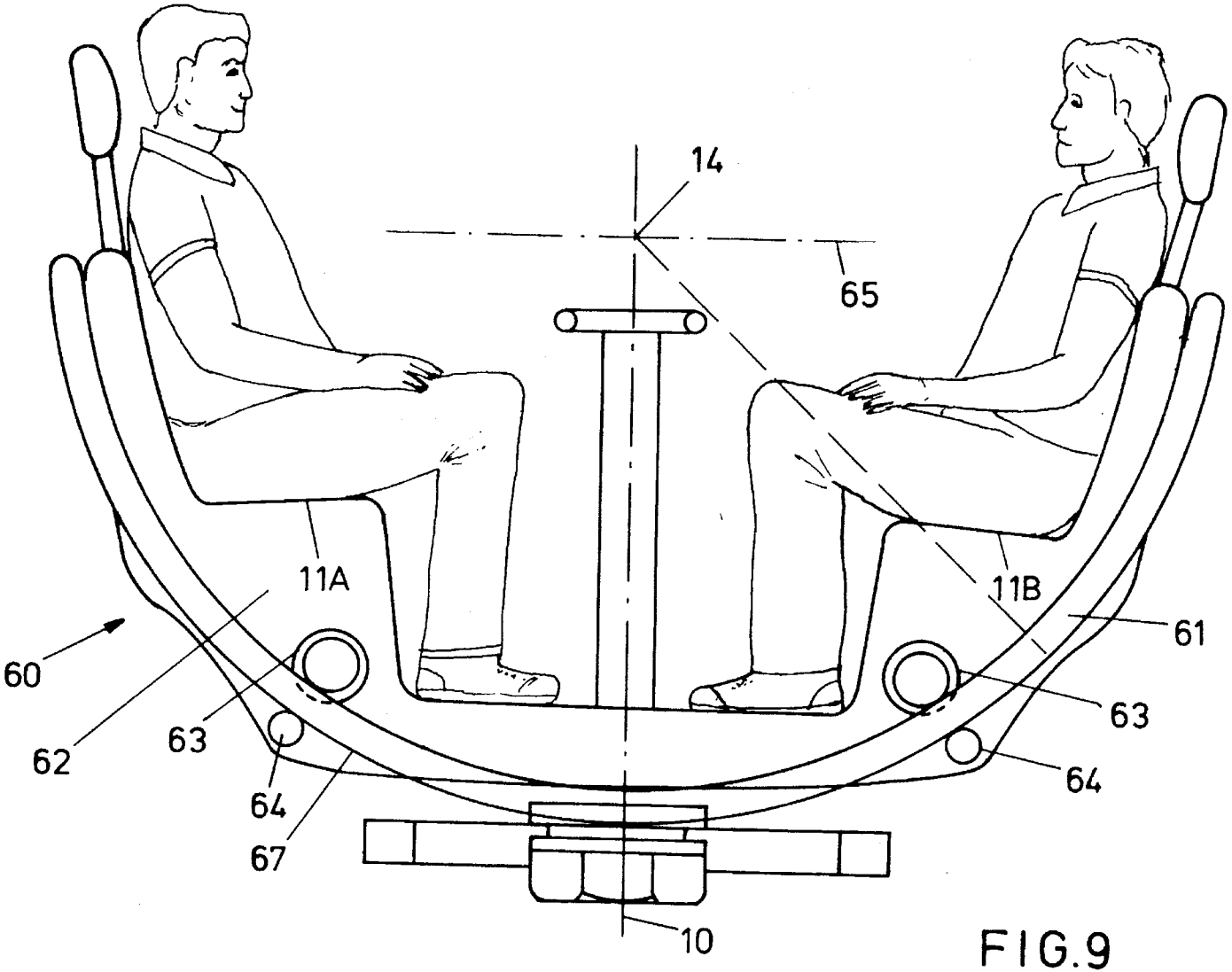

It is also possible to use seat supports 9 mounting oppositely arranged seats 62, as shown in FIG. 9, which may each have one or more seating positions 11A and 11B in side-by-side arrangement.

Further, the seats 11 in the embodiment of FIGS. 1 through 4 are so mounted that the passenger is seated facing away from the horizontal leg 9A of the seat support. However, the seats may also be mounted so that the passenger faces in a direction corresponding to the direction of the horizontal leg 9A.

Figure 11:
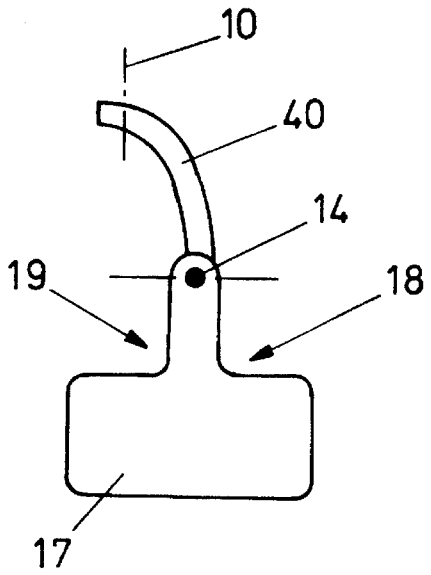

A seat may also have two or more seating positions in back-to-back relationship, such as the seat 17 having seating positions 18, 19 as shown schematically by way of example in FIG. 11. The seat shown in FIG. 11 is further suspended, by way of example, from the end of a depending arm 40 of a seat support. In that case, the seat is suspended from an arm and can rock about the third axis 14.

Figure 2:
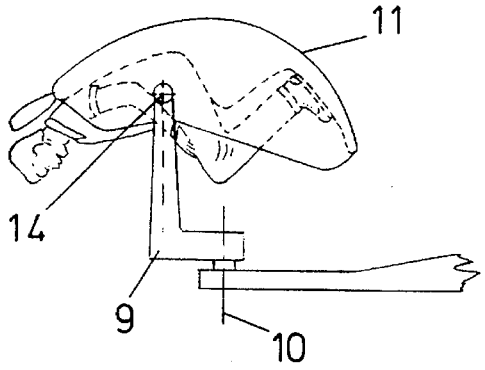
FIGS. 2, 3 and 4 are diagrammatic views of a part of a device according to FIG. 1 in three different positions/of the seats during operation.
Figure 3:
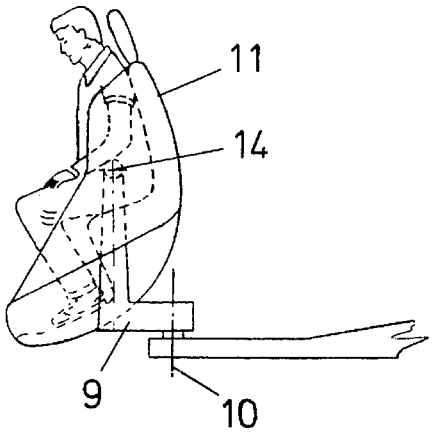
Figure 4:
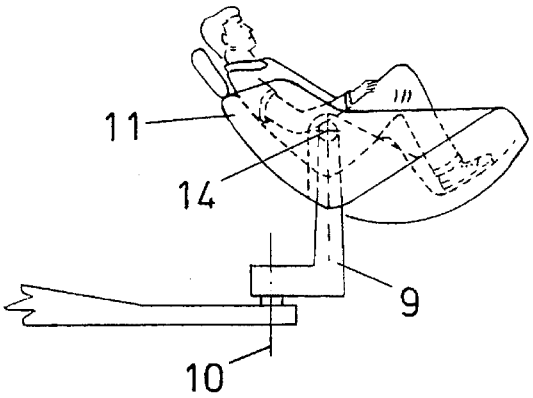

The seat can be mounted in a manner permitting it to rock back and forth only, but it could alternatively be mounted in a manner permitting rotation through 360° in the (substantially) vertical plane, as shown in FIG. 2.

Figure 10:
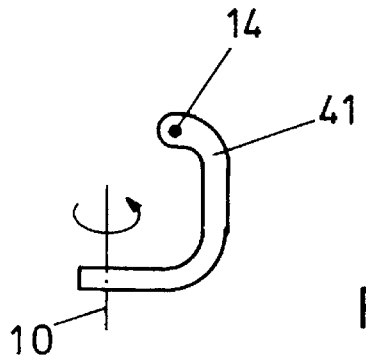
Figure 12:
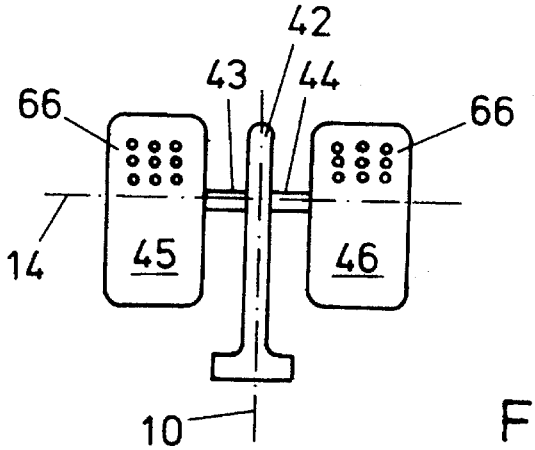

The seat support may be substantially L-shaped in side elevation, as shown in FIG. 1, but may have any other suitable form. A suitable form is the approximately C-shaped design as shown in FIG. 10 at 41. Further, the upper part of the seat support (or the lower part in the case of depending seats as shown in FIG. 11) may be U-shaped, as shown in FIG. 8, the seat being mounted between the legs of the U-shape. FIG. 12 is a schematic rear view of another configuration, where the seat support has a central upright leg 42 having projecting transverse arms 43, 44, i.e. in a generally T-shape of the part, carrying at least one seat 45, 46 rotatably mounted on a transverse arm of the generally T-shaped part on opposite sides of the upright leg of the T-shaped part. The seats may comprise one or more seating positions. The transverse third axis about which the seats can rock or rotate is indicated at 14. This third axis could optionally be slightly inclined, so that the rocking motion occurs in a plane that is not parallel to a fourth axis of rotation 7 of intermediate disc 6 or the axis of rotation 3.

Figure 15:
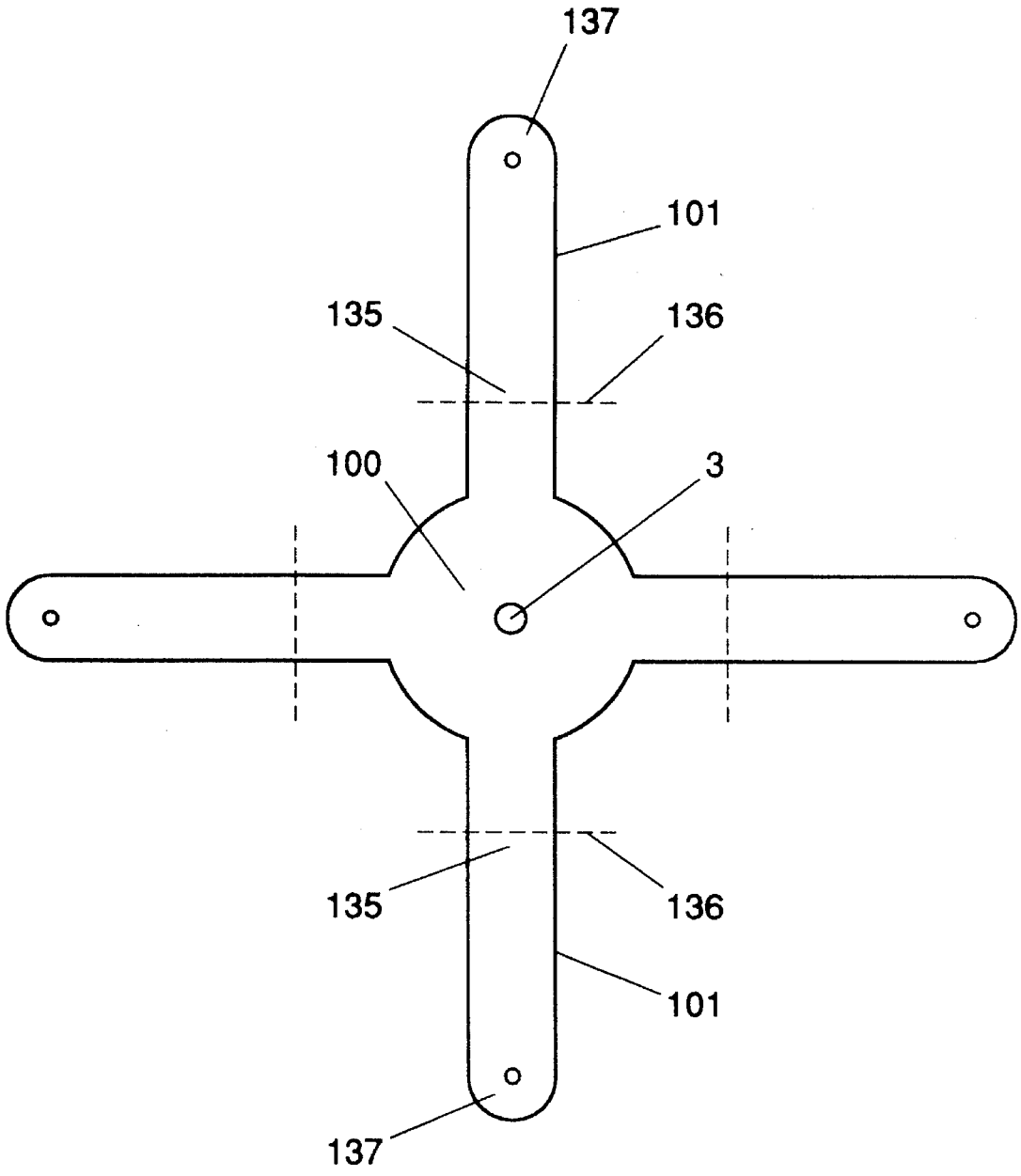
FIG. 15 is a diagrammatic top plan view of another variant of the device according to the invention.

Instead of a base disc 4 or an intermediate disc 6, as shown in FIG. 1, a hub 100 fitted with radial arms 101 can be used, as shown in FIG. 15. In this embodiment, the radial arms 101 carry, spaced from the hub 100, either the seat supports 9 or an intermediate disc 6 which may be a hub, such as hub 100, with radial arms, such as arms 101. In this variant of the invention, the arms may be pivotable about an axis 136 extending perpendicularly to the longitudinal dimensions of the arms and located between the hub and free ends of the arms. Such pivoting may be achieved by motors or hydraulic cylinders (not shown) similar to that shown in FIG. 16.

Figure 5:
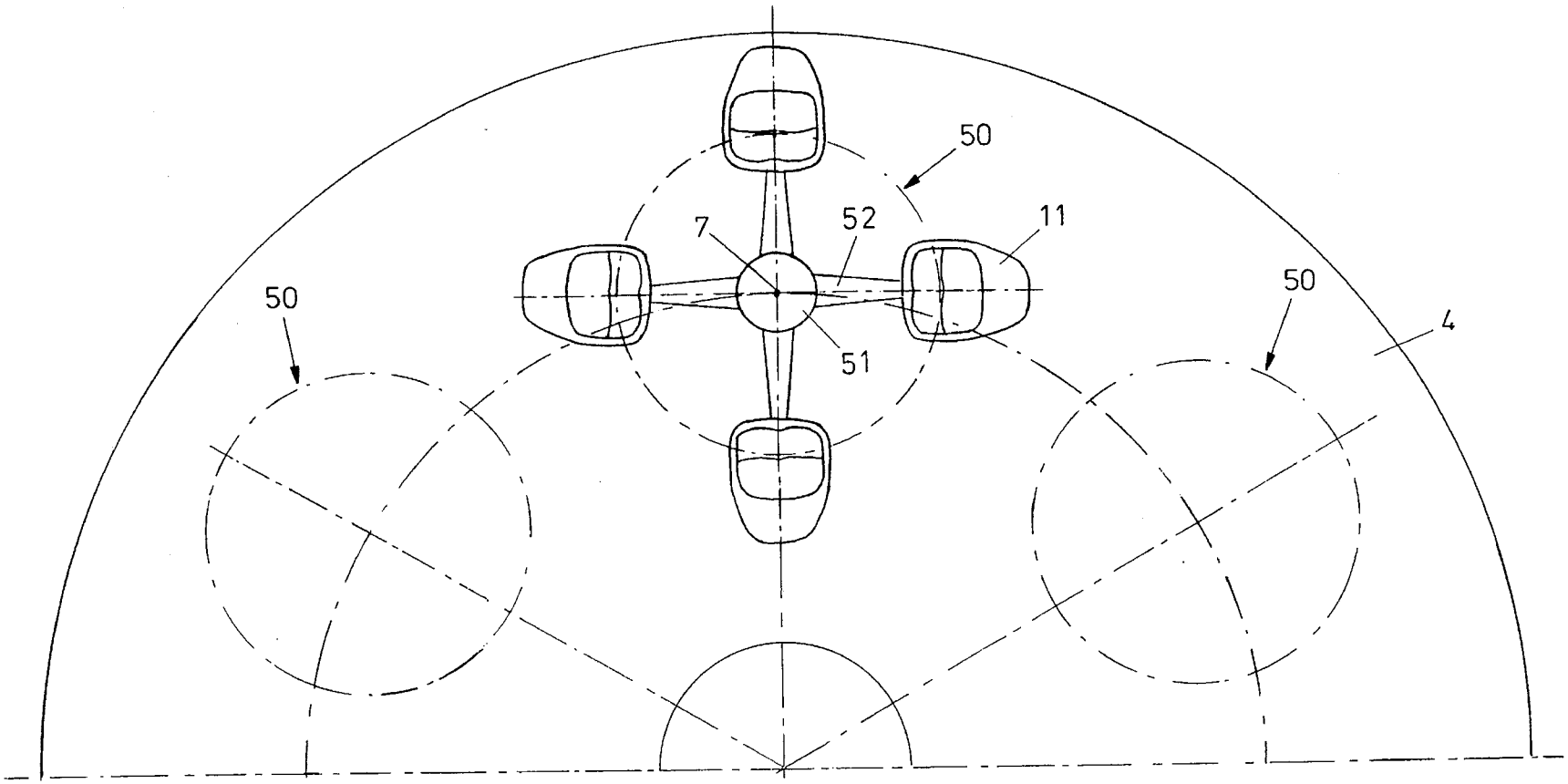
FIG. 5 is a diagrammatic top plan view of a part of a second embodiment of a fairground device according to the invention.

FIG. 5 is a schematic top plan view of an embodiment with a base disc 4 and a plurality of intermediate discs 50 each consisting of a hub 51 provided with a plurality of radial arms 52. In the embodiment shown, four radial arms 52 are used, each carrying a seat support 9 with a seat 11 for two persons. Here again, both the base disc 4 and intermediate disc 50 may be the hub and radial arm arrangement of FIG. 15.

Figure 6:
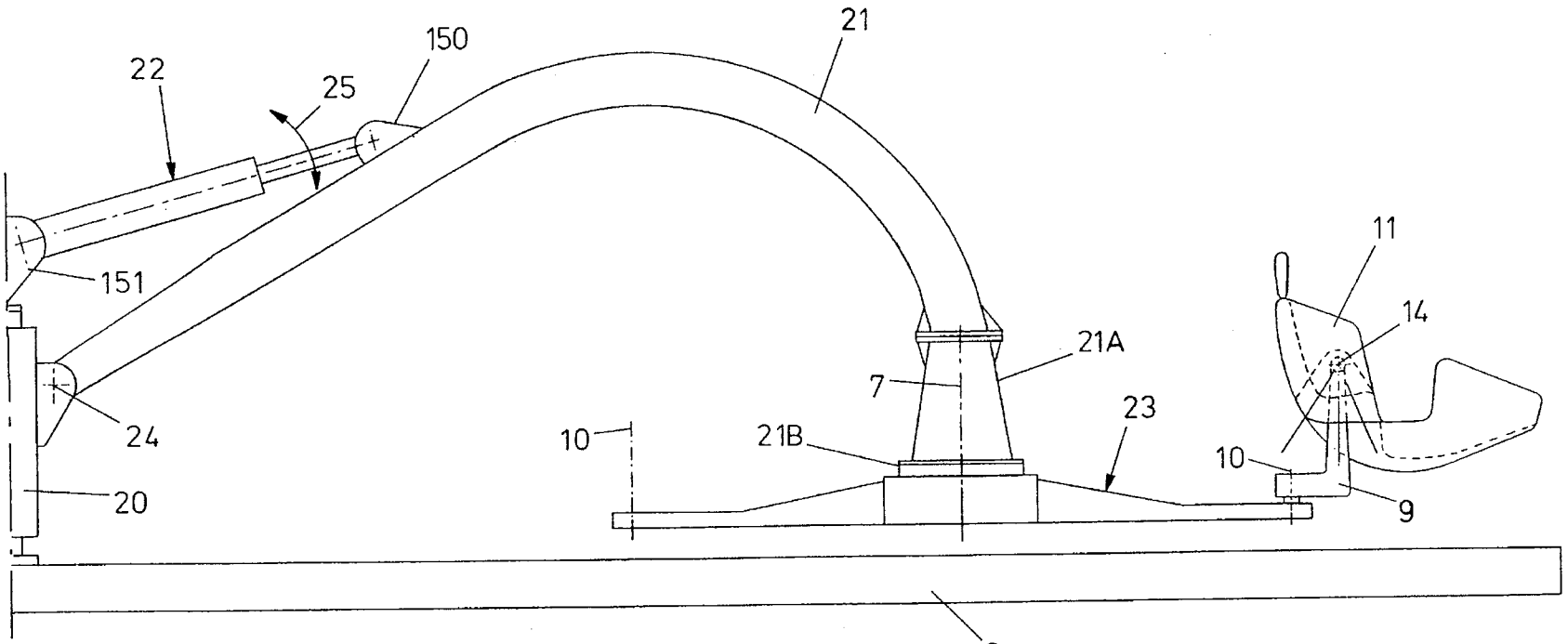
FIG. 6 is a diagrammatic view of yet another variant of a device according to the invention.

FIG. 6 is a schematic view of a part of an embodiment of a fairground device according to the invention, in which, instead of a base disc, a central hub 20 with a plurality of radial arms 21 is used. The radial arms each carry at their free ends or terminal part an intermediate disc 23 (which may be the hub and arm arrangement of FIG. 15), which in turn carries a plurality of seat supports 9 and seats 11 in one of the manners described above, e.g. where the seat supports are mounted in a depending manner and have a lowermost part from which the seats are suspended.

In this embodiment, the radial arms 21 first curve obliquely upwards from the central hub 20 while the terminal parts 21A of the arms 21 curve downward again. In this embodiment, the intermediate disc 23, which can be a disc or the hub and radial arms arrangement of FIG. 15, is suspended from the lower free end 21B of an arm 21.

This embodiment shows some resemblance to a fairground device known under the tradename "Poliep" (Polyp). Examples of such devices are, for instance, described in European Patent Application 0341759 and Netherlands Patent Application 7300751. However, a clear difference between the present and the known devices is the manner in which each seat is mounted.

In the embodiment shown in FIG. 6, the radial arms 21 are further mounted on the central hub 20 for pivotal motion about a transverse fifth axis 24 (transverse to the axis of hub 20). The position of the radial arm can be set by a positioning means, e.g. a hydraulic cylinder 22, which position can be controlled by a control means, e.g. manual or electrical control of the hydraulic fluid to the hydraulic cylinder. Optionally, the cylinder 22 can cause the arm to pivot up and down during operation, as is schematically indicated by an arrow 25. The hub can also be slightly inclined.

Further, the intermediate discs 23 may be located higher above the base plate 2 and the seat supports may be suspended from the intermediate disc 23 or mounted on an element rigidly connected to the radial arms 21. Such a configuration is schematically shown in FIG. 11. FIG. 11 shows a depending end 40 of a seat support, the seat being pivoted to the lower end of the seat support for pivotal motion about a transverse third axis 14. This manner of suspension can also be used in a disc arrangement instead of a radial arm arrangement, as discussed above. In that case, the intermediate disc 6 must be located relatively far above the base disc 4 or consist of a hub with upwardly curving arms which, in turn, may or may not be movable up and down and which themselves may carry a plurality of eccentrically rotatable seat supports with one or more seats suspended for rocking motion, as explained above.

In this case, too, therefore, in a manner similar to that used in the devices described hereinabove, by virtue of the freely rotatable arrangement of the seat support and the seat, the user is pressed straight against the seat during operation, so that the motions to which the user is subjected can be qualified as thrilling and yet comfortable.

Figure 7:
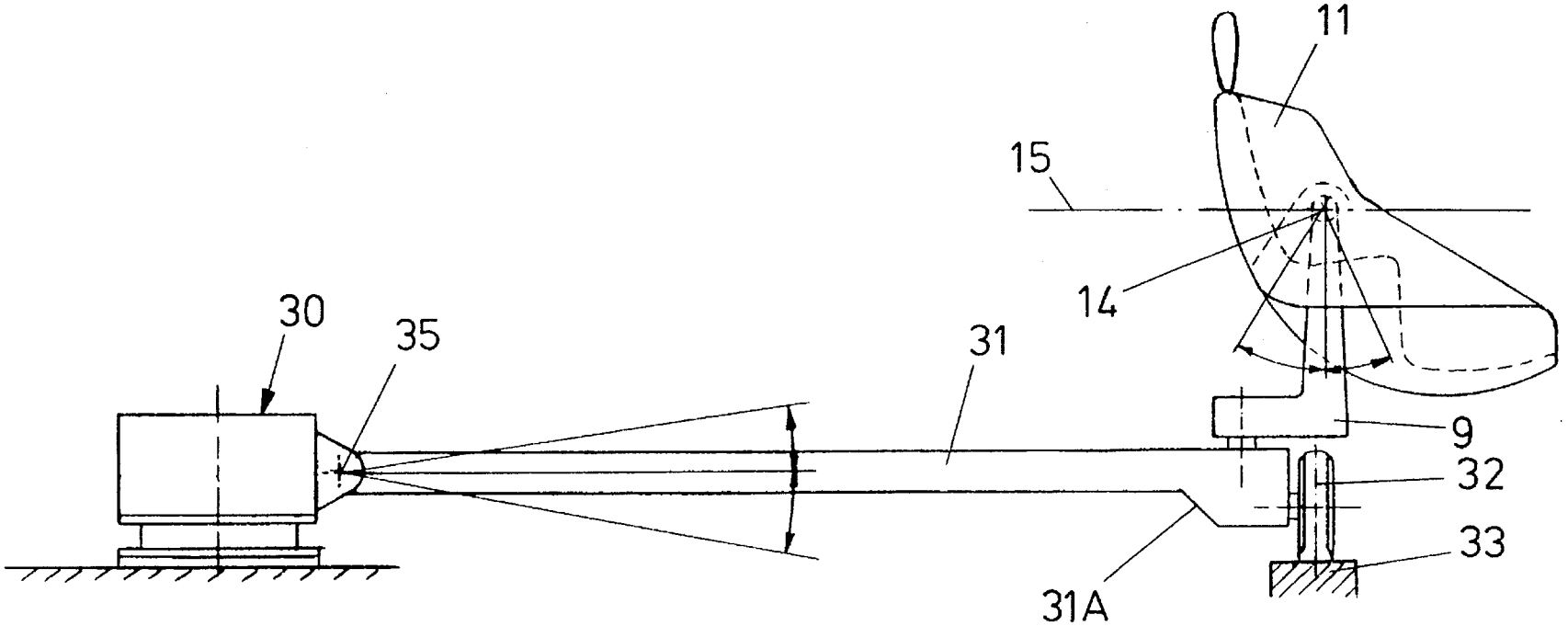
FIG. 7 is a diagrammatic view similar to the view of FIG. 1, of yet another embodiment of a fairground device according to the FIGS. 8 through 12, by way of example, are diagrammatic views of some embodiments of seat supports with associated seat configurations.

FIG. 7 schematically shows an embodiment of a fairground device according to the invention, in which the base disc again extends from a hub 30 driven for rotation, which may or may not be slightly inclined. The base disc is in the form of radial arms 31 pivoted to the hub at 35. In this embodiment, the radial arms are supported at the ends 31A by one or more rollers or wheels 32 which run over an endless track 33. The track can be planar, but preferably comprises at least one elevated part, e.g. parts at different heights, so that, upon rotation of the hub 30, the end of a radial arm 31 makes an up and down motion. The track 33 may, for instance, have a wavy configuration and/or have a main surface that is slightly inclined relative to the horizontal.

The radial arms 31 in turn carry one or more seat supports 9 mounted directly on radial arms 31 or via an intermediate disc (not shown) for eccentric rotation, having a plurality of seat positions arranged side-by-side and/or opposite and/or back-to-back relative to each other, as explained above. The seats are rotatable about the transverse third axis 14. The rotation about the third axis 14 may be undriven or driven.

FIG. 9 schematically shows an embodiment of a seat support 60 comprising one or more arcuate guide means 61, for instance curved rails, of which in this embodiment the convex side is turned downwards. Seats 62, which in the present embodiment comprises a plurality of opposite seating positions, comprises travelling means, for instance travelling rollers or sliding rollers 63, cooperating with the arcuate guide means 61 and which in operation can roll or slide or move otherwise along the guide means 61. In that case, the seats, in fact, rotate again about an (imaginary) third axis 14 extending transversely to the plane of the paper through the center of the arcuate form of the guide means 61. Arranged opposite the rollers 63 are counter guide means, e.g. counter-rollers 64, or similar members resting against the exterior 67 of the guide means 61 and keeping the seat pressed against the guide means 61.

Figure 13:
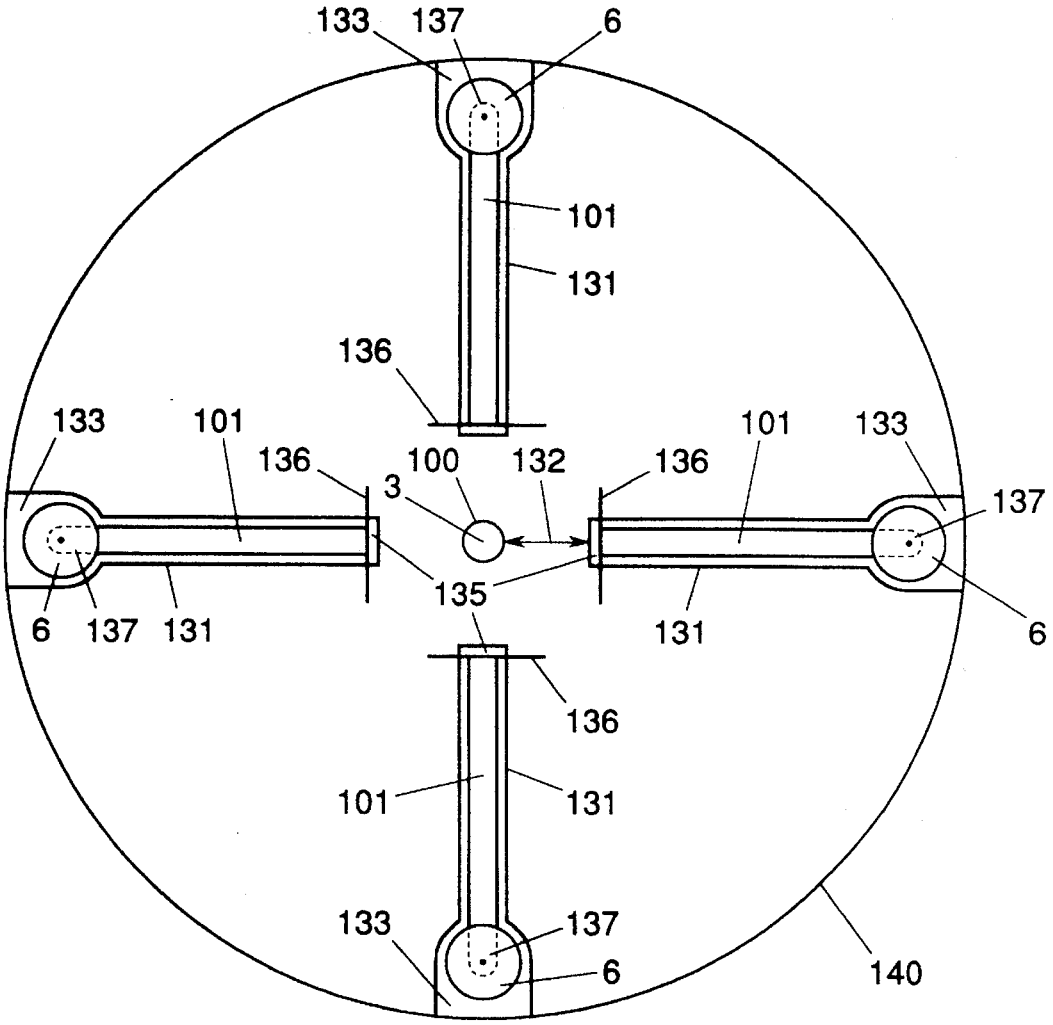
FIG. 13 is a diagrammatic top plan view of a variant of the deuce according to the invention.
Figure 14:
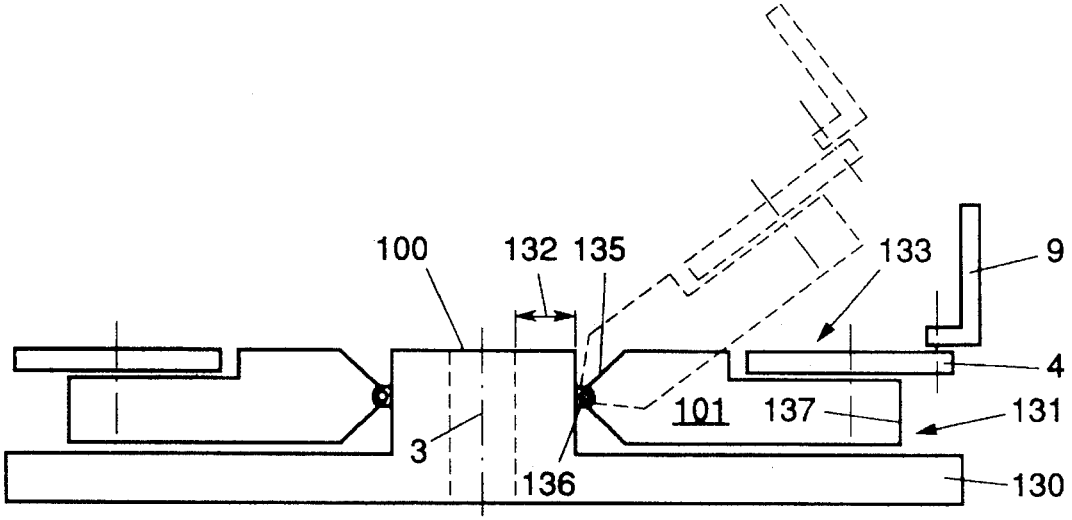
FIG. 14 is a sectioned side view of FIG. 13.

Another embodiment is shown in FIGS. 13 through 15. In this embodiment, a base disc 130 is provided with a plurality of radial grooves 131 (four being shown). The grooves 131 extend a distance 132 from the central axis 3 of hub 100 and radially outward therefrom to a peripheral zone 133. Radial arms 101 are disposed with inner ends 135 nearest the central axis 3 pivotally mounted on a horizontal axis 136. The outer ends 137 of each radial arm 101 carry a seat support 9 and/or an intermediate disc 6 in the same manner as the embodiments described above.

The radial arms 101 pivot on horizontal axis 136 in upward and downward directions, as indicated by the phantom lines of FIG. 14. The intermediate disc 6, if present, may or may not be in a recess in base disc 130 (FIG. 14 shows intermediate disc 6 in the recess of peripheral zone 133). The grooves may or may not extend to the peripheral circumference 140 of base disc 130 (FIGS. 13 and 14 show the grooves extending to the circumference 140).

Figure 16:
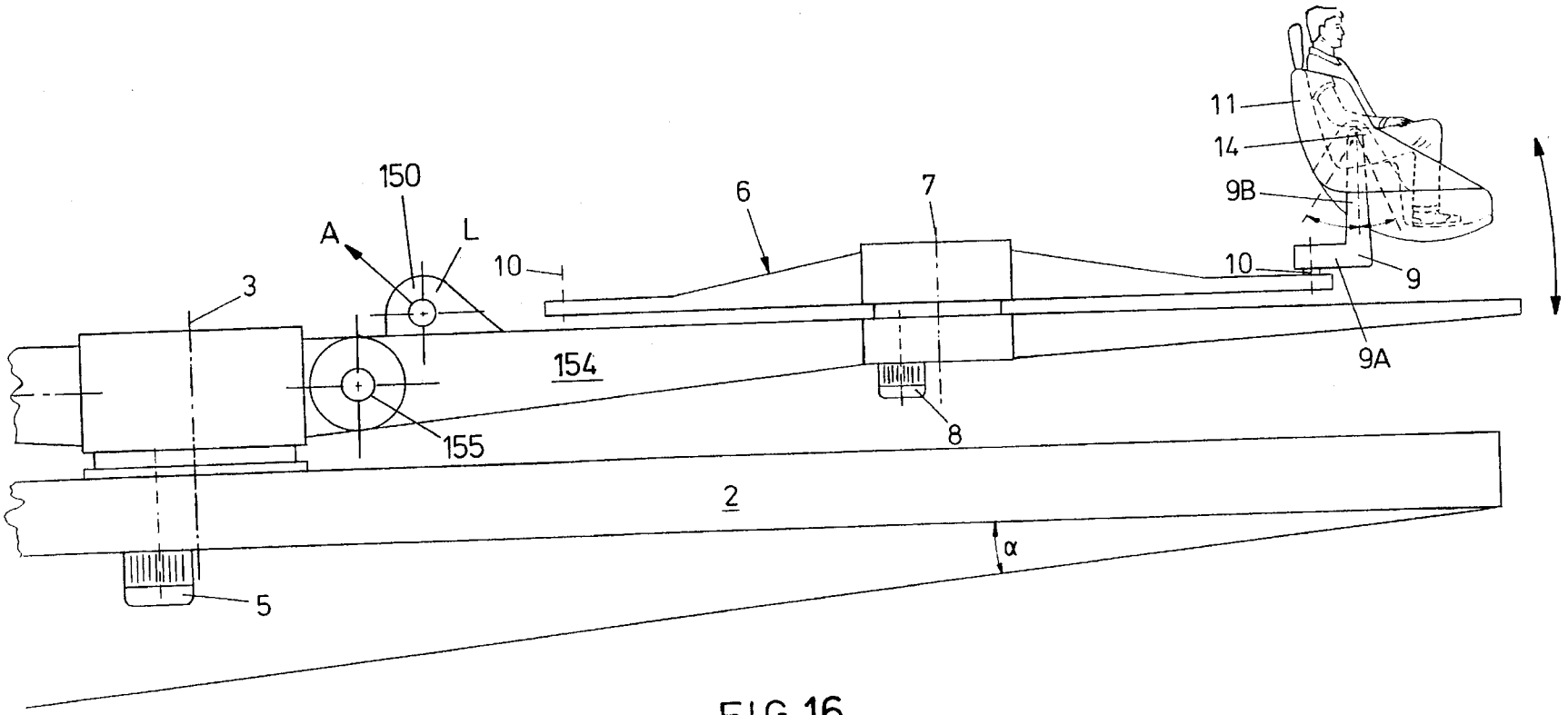
FIG. 16 shows another variant of the device of the invention with attachments for a hydraulic cylinder.

The radial arms may lie in grooves of the base disc, or they may extend above a flat plane, as shown in FIG. 16. The flat plane may be a stationary base plate 2, as shown in FIG. 16, but may also be a rather wide flange of a rotating base disc. Such a configuration in cross-sectional view has the same shape as in FIG. 14. The arms will, of course, be in the radial extended position when the device is at rest. After the passengers take their seats, the base disc starts rotating around axis 3. Preferably, only after the base disc has started its rotation, the arms will be activated to pivot in an upward direction around pivot axes 136. The arms may either maintain a predetermined inclined position throughout the ride or may be moving up and down a number of times during the ride.

Upward and downward movement of radial arms 101 is achieved by a motive means, e.g. a hydraulic cylinder or a motor or the like, disposed below or above the radial arms 101. For example, FIG. 16 shows a lug 150 which may connect to an end of a hydraulic cylinder 22 (see FIG. 6) and connect at another end to a similar lug 151 of central hub 20 (also see FIG. 6). The radial arm 154 (see FIG. 16) pivots about pivot axis 155 (upwardly and downwardly) by action of hydraulic cylinder 22. Alternatively, the hydraulic cylinder may be disposed underneath radial arm 154, with an appropriate lug underneath the radial arm and an appropriate lug on a portion of hub 20 underneath the radial arm which rotates with the radial arm (not shown in the drawings) or on a disc lying under and/or encasing the radial arm, as shown in FIG. 14.

In operation of this embodiment, as can be better seen from FIG. 14, as base disc 130 rotates about central axis 3, radial arms 101 can be inclined, as shown by the phantom lines, and this inclination provides a substantially greater thrill to the passengers on the fairground device.

It is observed that, after the foregoing, various modifications of the embodiments shown are apparent. For example, the seats in the embodiments described are mounted in such a manner that the rocking motion about third axis 14 occurs in forward and backward directions, from the viewpoint of the passengers. However, it is also possible to provide for a lateral rocking motion about an axis extending transversely to third axis 14. By way of example, FIGS. 7 and 9 show such an axis at 15 and 65. A combination of the two rocking motions can be obtained by means of a cardan suspension of the seats.

It is further noted that combinations of the various options in respect of motion and mounting of the seats and the seat supports are apparent. If the rotation of the seat support or a seat is a motion driven by a motor, it is advantageous to use for this purpose a separate motor which is supplied via slip ring contacts at the bottom of the seat support. Such slip ring contacts are typically provided anyway for energizing lamps provided to the device, for instance, on the backs of the seats. Such lamps are indicated by way of example at 66 in FIG. 12.

Further, the central axis, the axis of an intermediate disc and the second axis can be parallel, as in FIG. 1, but this is not necessary. Two of these axes or even all of these axes could be arranged at an angle relative to each other. These and similar modifications are considered to fall within the scope of the invention.

Thus, from the various embodiments described above, it can be seen that a wide variety of motions can be imparted to the passengers by appropriate choice of the various above-described axes, seat supports and undriven or driven rotations, as well as inclinations, of the device. For any particular device, a selection among these can result in a less thrilling ride, e.g. for children, or a very thrilling device, e.g. for adults. In addition, it is quite apparent that these various axes, seat supports, rotations and inclinations can be locked into such motions or locked out of such motions so that the fairground device can easily be quickly adapted to a less thrilling device, e.g. for children, or a very thrilling device, e.g. for adults, or any degree of thrill therebetween.

What is claimed is:

1. In a fairground device having a plurality of seats comprising a base disc driven for rotation about a central axis and at least one seat support(s) carried by the base disc in a spaced relation relative to the central axis for rotation of the seat support(s) about a second axis, the seat support(s) carrying at least one seat mounted eccentrically relative to a corresponding second axis, the improvement comprising:

the seats mounted on at least one seat support(s) for rotation about a third axis extending substantially transversely to the second axis, the base disc having a plurality of longitudinally extending radial arms pivotally connected to a central hub for pivoting the radial arms about an axis extending transversely to the longitudinally extending radial arms and for carrying the seat support(s) and positioning means for setting the pivotable position of the radial arms.

2. A fairground device according to claim 1, wherein the positioning means comprise wheels or rollers, carried by the radial arms, which run over an endless track.

3. A fairground device according to claim 2, wherein the endless track comprises parts at different heights.

4. A fairground device according to claim 3, wherein the endless track has a wavy configuration.

5. A fairground device according to claim 1, wherein the positioning means comprise a piston-cylinder assembly mounted to each radial arm.

6. A fairground device according to claim 5, further comprising a control means for the piston-cylinder assembly which cause the radial arms to pivot up and down.

7. A fairground device according to claim 5, wherein the piston-cylinder assembly is mounted between each radial arm and the central hub.

8. A fairground device according to claim 1, wherein each radial arm has a first part extending obliquely upwards from the central hub and a downwardly curving terminal part.

9. A fairground device according to claim 1, wherein the seat support(s) are mounted to a plurality of intermediate discs which are carried by the radial arms.

10. A fairground device according to claim 9, wherein the intermediate discs are mounted on a terminal part of the radial arms.

11. A fairground device according to claim 10, wherein the seat supports are mounted in depending manner and have a lowermost part from which the seats are suspended.

12. A fairground device according to claim 9, wherein the intermediate discs have a hub and a plurality of radial arms each carrying the seat supports.

13. A fairground device according to claim 9, wherein drive means are provided for rotating the intermediate discs about a fourth axis.

14. A fairground device according to claim 1, wherein the seat supports have at least one U-shaped part, and at least one seat is rotatably mounted between the legs of the U-shaped part.

15. A fairground device according to claim 1, wherein the seat supports have at least one generally T-shaped part, at least one seat being rotatably mounted on a transverse arm of the generally T-shaped part on opposite sides of an upright leg of the generally T-shaped part.

16. A fairground device according to claim 1, wherein the seat supports comprise at least one substantially arcuate guide means, the seats being provided with a plurality of counter guide means which can move along the guide means, the seats thereby performing a rocking motion.

17. A fairground device according to claim 1, wherein the seat supports comprise a first part carrying the seats that points away from a second part that supports the seats and has an orientation different from the first part, said first part comprising a hub rotatable about the second axis.

18. A fairground device according to claim 1, wherein an electrical power supply is obtained by slip ring contacts arranged around the second axis.

19. A fairground device according to claim 18, wherein the slip ring contacts supply electrical power to an electric motor, said electric motor driving the rotation of the seats.

20. A fairground device according to claim 1, wherein drive means are provided for driving the seat supports for rotation about the second axis.

21. A fairground device according to claim 1, wherein drive means are provided for driving the seats for rotation about the third axis.

22. A fairground device according to claim 1, wherein the third axis permits a rotation of the seats in forward and backward direction with respect to the third axis.

23. A fairground device according to claim 1, wherein the third axis permits a rotation of the seats in lateral direction with respect to the third axis.

24. A fairground device according to claim 1, wherein the central hub has a broad lower flange above which the radial arms extend.

25. A fairground device according to claim 24, wherein the positioning means comprises a piston-cylinder assembly mounted between each radial arm and the broad flange.

26. A fairground device according to claim 1, wherein the radial arms, when at rest, lie at least partially in grooves extending radially in the base disc from the central hub.

* * * * *